US005261311A

United States Patent [19]

Cloup

[11] Patent Number: 5,261,311

[45] Date of Patent: Nov. 16, 1993

[54] RECIPROCATING HYDRAULIC MOTOR WITH A DIFFERENTIAL PISTON

[75] Inventor: Philippe Cloup, Lussac, France

[73] Assignee: Société Civile De Récherche Sam, Lussac, France

[21] Appl. No.: 915,916

[22] Filed: Jul. 16, 1992

[30] Foreign Application Priority Data

Jul. 18, 1991 [FR] France ..... 9109105

[51] Int. Cl.[5] ..... F01L 21/04; F01B 31/00

[52] U.S. Cl. ..... 91/229; 91/222; 91/321; 92/181 P; 60/370

[58] Field of Search ..... 91/222, 224, 226, 227, 91/228, 229, 321; 92/181 R, 181 P; 60/370, 371

[56] References Cited

U.S. PATENT DOCUMENTS

| | | | |
|---|---|---|---|
| 119,076 | 9/1871 | Chandler | 91/226 |
| 245,310 | 8/1881 | Morrison | 91/222 |
| 437,097 | 9/1890 | Coffield | 91/229 |
| 2,987,051 | 6/1961 | Goyette et al. | 91/229 |
| 4,756,329 | 7/1988 | Cloup | 91/224 X |
| 5,137,435 | 8/1992 | Walton | 91/229 X |

*Primary Examiner*—Edward K. Look
*Assistant Examiner*—Hoang Nguyen
*Attorney, Agent, or Firm*—Weiser & Associates

[57] ABSTRACT

The invention relates to a reciprocating hydraulic motor having a differential piston interposed between an inlet pipe for fluid at a pressure P1 and an exhaust pipe for fluid at a pressure P2 which is less than the pressure P1. The moving assembly constituted by the different-section pistons that slide in a stepped cylinder includes a flap having two positions and controlling three ports, the flap being mounted to pivot about an axis. In each of its positions, the flap bears against two wall portions disposed on opposite sides of the flap and at different distances from the pivot axis so that the effect of the pressures P1 and P2 on the faces of the flap is to establish a positive closure torque.

9 Claims, 3 Drawing Sheets

RECIPROCATING HYDRAULIC MOTOR WITH A DIFFERENTIAL PISTON

The present invention relates to differential piston reciprocating hydraulic motors using the energy of a main fluid for generating their motion.

BACKGROUND OF THE INVENTION

The basic principle of such motors is to transfer the inlet fluid at a pressure P1 into a variable-volume intermediate chamber which, after inlet valves have closed and exhaust valves have opened, empties to an outlet as a fluid flowing at the same rate but at a pressure P2 which is less than the pressure P1.

The overall energy used by such hydraulic motors is a function of the fluid flow rate and of the difference between the pressures P1 and P2.

A very important component part in a device of this type is the assembly constituted by its inlet and exhaust valves and by the control system therefor.

In general, present devices use slide valves or mushroom-shaped poppet valves. This gives rise to systems that are complex.

SUMMARY OF THE INVENTION

The object of the present invention is to provide a simplified reciprocating hydraulic motor.

According to the invention, the object is achieved by the fact that the proposed reciprocating hydraulic motor includes a single valve which, on its own, suffices to control both the filling and the emptying of the volumes concerned.

The present invention thus provides a reciprocating hydraulic motor having a differential piston interposed between an inlet duct for fluid at a pressure P1 and an exhaust duct for fluid at a pressure P2 less than P1, the motor being of the type comprising:

a stepped cylinder;

a moving assembly comprising two pistons of different sections, the pistons being interconnected and being mounted to slide in sealed manner inside said stepped cylinder, said moving assembly co-operating with the inside wall of said stepped cylinder to delimit three variable-volume chambers including an inlet chamber interposed between said two pistons and into which said inlet pipe opens out, an exhaust chamber disposed on the opposite side of the smaller section piston from said inlet chamber and into which the exhaust pipe opens out, and an intermediate chamber situated on the opposite side of the larger diameter piston relative to said inlet chamber;

a first passage allowing said inlet chamber to be put temporarily into communication with said intermediate chamber;

a second passage enabling said intermediate chamber to be put temporarily into communication with said exhaust chamber; and control means for opening and closing said first and second passages in alternation during each operating cycle.

Such a motor makes it possible to transfer a volume of fluid automatically on each operating cycle from said inlet pipe to said intermediate chamber, and then to transfer the same volume of fluid from said intermediate chamber to the exhaust pipe under the action of the pressure difference P1-P2, and of said control means.

According to the invention, said first passage and said second passage are formed by a cavity located in said moving assembly and by three ducts putting said cavity into communication respectively with said inlet chamber, with said exhaust chamber, and with said intermediate chamber, and said control means comprise a single flap disposed in said cavity and pivotally mounted on a pivot shaft situated in the general plane of said flap and extending substantially perpendicularly to the general plane of said ducts, and actuator means for said flap carried by said moving assembly and actuating said flap so as to enable it to take up two positions during each operating cycle including:

a first position in which said inlet chamber communicates with said intermediate chamber while said exhaust chamber is isolated; and a second position in which said intermediate chamber communicates with the exhaust chamber, while said inlet chamber is isolated.

The flap mounted on the moving assembly thus behaves like a two-position valve member of a three-port valve.

In order to ensure that the flap is stable in each of said positions, said flap bears in each of said positions against two portions of the wall of said moving assembly, said two walled portions being situated on opposite sides of the general plane of said flap. Relative to the general plane of said flap, one of said wall portions is disposed on the same side as the fluid at the pressure P1 while the other of said wall portions is disposed on the same side as the fluid at the pressure P2. The wall portion situated on the same side as the fluid at the pressure P2 is further away from the pivot shaft than is the other wall portion such that the fluid pressures acting on the two faces of the flap establish positive closure torque. Advantageously, the actuator means for said flap comprise:

a trip rod slidably mounted on said moving assembly to slide parallel to the displacement direction of said pistons, said trip rod being suitable for being displaced relative to the moving assembly when it comes into abutment against the walls of said stepped cylinder, a crank secured to the pivot shaft of said flap, and a spring interposed between said crank and said trip rod and designed to toggle the flap during displacement of the trip rod.

Preferably, said crank is pivotally mounted on said pivot shaft in such a manner that the torque exerted by the spring after the crank has toggled is greater than the positive closure torque exerted by the fluid pressures.

Advantageously, the cavity of said moving assembly has two mutually parallel walls extending perpendicularly to the pivot axis, the wall portions co-operating with the flap being substantially parallel to the pivot axis.

BRIEF DESCRIPTION OF THE DRAWINGS

An embodiment of the invention is described by way of example with reference to the accompanying drawings, in which.

DETAILED DESCRIPTION OF THE INVENTION

Figure 1:
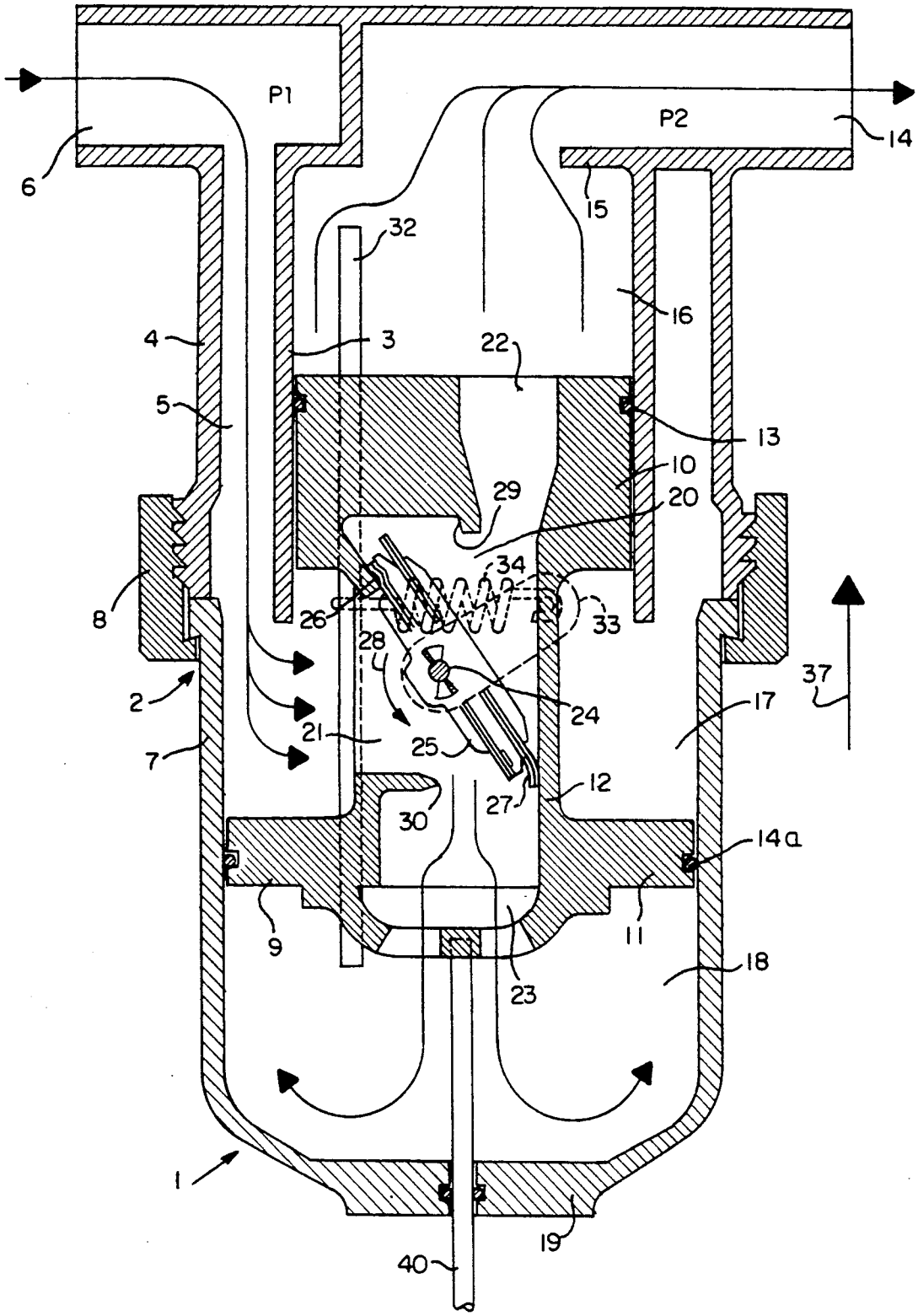
FIG. 1 is a longitudinal section through a reciprocating hydraulic motor of the present invention during the stage in which the intermediate chamber is filled.

The reciprocating hydraulic motor 1 shown in the drawings comprises a stepped cylinder 2 constituted by two concentric sleeves 3 and 4 delimiting an annular space 5 between them into which an inlet duct 6 for a fluid at a pressure P1 opens out. The outer sleeve 4 is extended by a cylindrical bell 7 fixed to the outer sleeve 4 by a ring 8. The inside diameter of the bell 7 is greater than the inside diameter of the inner sleeve 3. The inner sleeve 3 and the bell 7 constitute the inside wall of the stepped cylinder 2. A moving assembly 9 is slidably mounted in sealed manner inside the stepped cylinder 2 and comprises two pistons 10 and 11 of different diameters which are connected together by a body 12. The smaller diameter piston 10 is slidably mounted in sealed manner inside the inner sleeve 3 with a piston ring 13 being interposed between them. The larger diameter piston 11 is slidably mounted in sealed manner in the bell 7 with a piston ring 14*a* being disposed between them.

The exhaust pipe 14 for fluid at the pressure P2 opens out via the end wall 15 of the inner sleeve 3 furthest from the bell 7 into an exhaust chamber 16 of variable volume situated between the smaller section piston 10 and the end face 15.

The annular space 5 communicates permanently with a variable volume inlet chamber 17 situated in the stepped cylinder 2 between the pistons 10 and 11.

A variable volume intermediate chamber 18 is delimited by the end wall 19 of the bell 7 and by the larger diameter piston 11.

A cavity 20 is provided in the body 12 of the moving assembly 8. This cavity 20 communicates with the inlet chamber 17 via a first duct 21. It also communicates with the exhaust chamber 16 via a second duct 22 passing through the piston 10, and with the intermediate chamber 18 via a third duct 23 passing through the piston 11.

A valve flap 25 is pivotally mounted on a pivot shaft 24 inside the cavity 20. The pivot shaft 24 lies in the general plane of the flap 25 and is substantially perpendicular to the general plane defined by the three ducts 21, 22, and 23.

Figure 2:
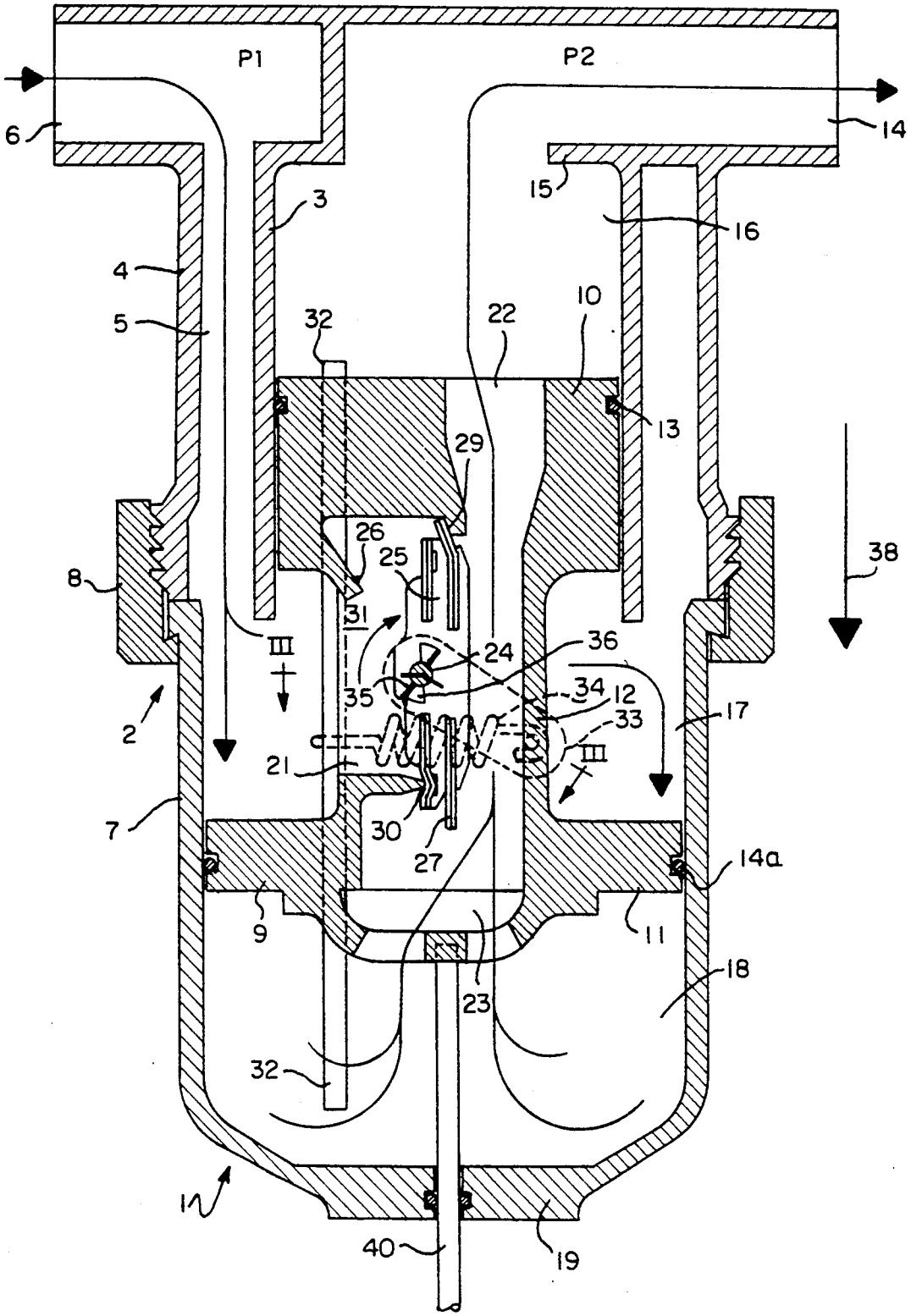
FIG. 2 is a longitudinal section through the motor of FIG. 1 during the stage in which the intermediate chamber is emptied.
Figure 3:
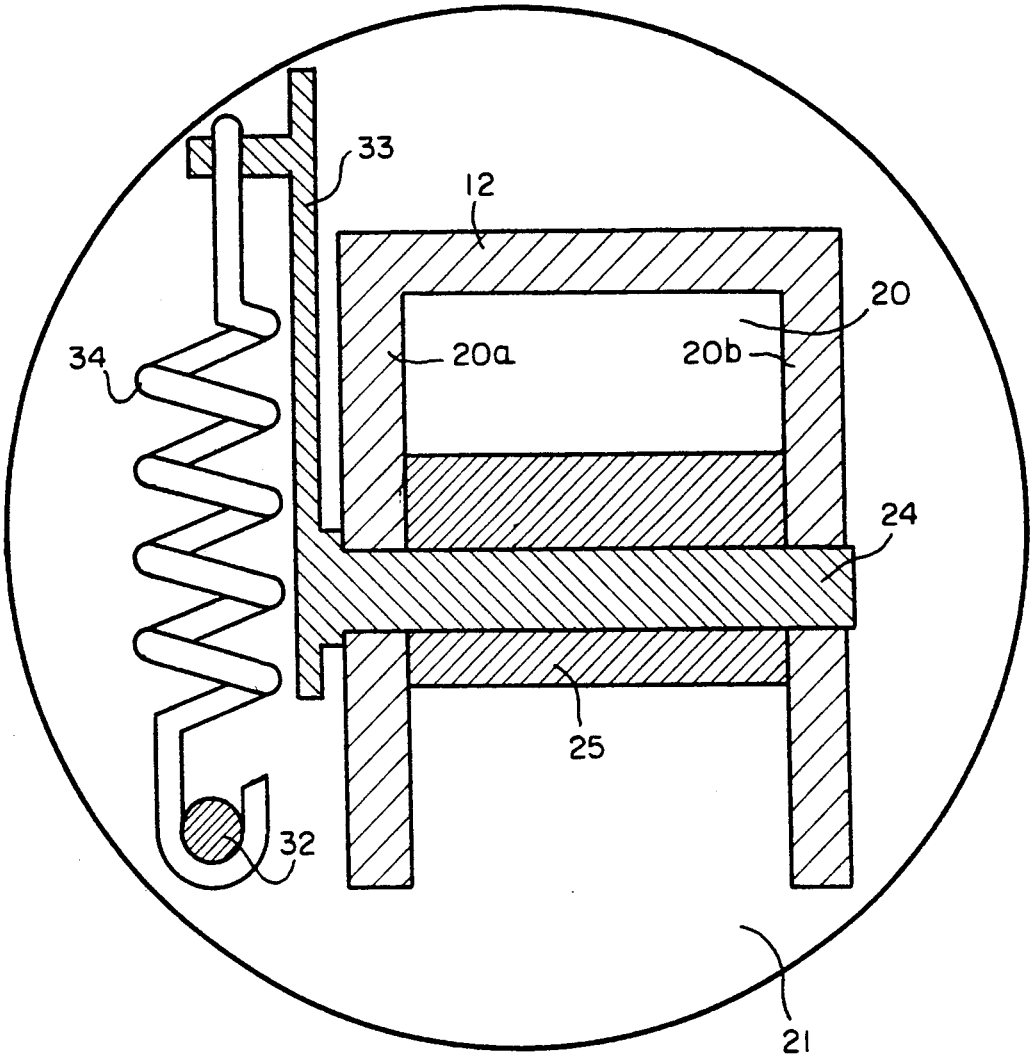
FIG. 3 is a cross-section through the motor, taken along the line III—III of FIG. 2.

The flap 25 can take up two extreme positions: in a first position as shown in FIG. 1 the inlet chamber 17 is in communication with the intermediate chamber 18 via the ducts 21 and 23, while the exhaust chamber 16 is isolated; and in a second position as shown in FIG. 2, the inlet chamber 17 is isolated while the exhaust chamber 16 is in communication with the intermediate chamber 18 via the ducts 22 and 23.

In the first position as shown in FIG. 1 the flap 25 bears against two wall portions 26 and 27 so as to isolate the exhaust chamber 16.

The wall portions 26 and 27 are situated on either side of the pivot shaft 24 and on either side of the general plane of the flap 25. Wall portion 26 is situated on the same side of the flap 25 as its face which is subjected to the pressure P1. In contrast, wall portion 27 is situated on the same side of the flap as its face which is subjected to the pressure P2 which is less than P1. The distance between wall portion 27 and the pivot shaft 24 is greater than the distance between wall portion 26 and the pivot shaft 24. The pressures P1 and P2 acting on the two faces of the flap 25 therefore exert a resulting torque on the flap, as represented by arrow 28, which tends to hold the flap 25 positively in its first position.

In the second position as shown in FIG. 2, the flap 25 also bears against two wall portions 29 and 30 disposed on opposite sides of the pivot shaft 24 and on opposite sides of the general plane of the flap 25. One of the faces of the flap 25 is likewise subjected to the pressure Pl while its other face is subjected to the pressure P2. Wall portion 29 situated on the P2 pressure side is further from the pivot shaft 24 than is wall portion 30 which is situated on the same side of the flap 25 as its face which is subjected to the pressure P1. In this case also, the flap 25 is subjected to a resultant positive closure torque, as represented by arrow 31.

The cavity 20 preferably has two walls 20*a* and 20*b* perpendicular to the pivot shaft 24, and the wall portions 26, 27, 29, and 30 are preferably rectilinear and parallel to the pivot shaft 24. The flap 25 is then substantially rectangular in shape and has gaskets on its edges that co-operate with the walls 20*a* and 20*b*. The flap 25 is made in conventional manner by resilient membranes interposed between stiffening plates.

The flap 25 is carried by the pivot shaft 24 which passes through at least one of the walls of the body 12 of the moving assembly 9, e.g. the wall 20*a*.

The flap 25 is actuated by actuator means which comprise a trip rod 32, a crank 33 secured to the pivot shaft 24, and a spring 34 interposed between the trip rod 32 and the free end of the crank 33.

The trip rod 32 is slidably mounted on the moving assembly 9 and extends parallel to the displacement directions of the moving assembly 9 inside the stepped cylinder 2. The trip rod 32 is displaced relative to the moving assembly 9 when its ends come into abutment against the walls of the stepped cylinder 2, e.g. its end walls 15 and 19. This displacement causes the spring 34 to pivot about the free end of the crank 33 and sets up an opposing torque that causes the flap 25 to tilt when said torque is greater than the corresponding one of the above-mentioned torques 28 or 31.

In order to ensure that the flap 25 toggles suddenly and cleanly, the crank 33 is mounted to pivot on the pivot shaft 24. As can be seen in FIGS. 1 and 2, the pivot shaft 24 has two diametrically opposite lugs 35 received in two sector-shaped openings 36 so as to allow the crank 33 a certain amount of angular clearance about the pivot shaft 24 when the spring 34 pivots due to displacement of the trip rod 32.

One operating cycle of the motor 1 is described below.

The flap 25 is in its first position as shown in FIG. 1. The moving assembly 9 is in its low position, and the trip rod 32 is in its high position relative to the moving assembly 9. The inlet chamber 17 and the intermediate chamber 18 are at the pressure P1. The exhaust chamber 16 is at the pressure P2. Because of the difference in the sections of the pistons 10 and 11, the moving assembly 9 moves upwards in the direction of arrow 37. A volume of fluid is transferred from the inlet pipe 6 into the intermediate chamber 18. The same volume of fluid is expelled from the exhaust chamber 16 into the exhaust pipe 14. The force used for moving the moving assembly is produced on the section of the piston 10 by virtue of the pressure difference (P1–P2).

In the end, the trip rod 32 comes into abutment against the wall 15, thereby causing the spring 34 to pivot about the free end of the crank 33. The moving assembly 9 continues to move upwards.

Finally, the crank 33 pivots about the pivot shaft 24, thereby striking the lugs 35 against the side walls of the openings 36 and tilting the flap 25 suddenly from its first position to its second position, as shown in FIG. 2. The trip rod 32 is now in its low position relative to the moving assembly 9.

The exhaust chamber 16 and the intermediate chamber 18 now contain fluid at the pressure P2. The inlet chamber 17 contains fluid at the pressure P1. The moving assembly 9 moves downwards in the direction of arrow 38. The force used in this motion for driving the motor is equal to the product of the difference between the sections of the pistons 10 and 11 multiplied by the pressure difference (P1–P2). A volume of fluid is transferred from the intermediate chamber 18 to the exhaust chamber 16.

In the end, the trip rod 32 comes into abutment against the wall 19, thereby causing the spring 34 to pivot in the opposite direction about the free end of the crank 33, and subsequently causing the crank 33 to pivot in the opposite direction about the pivot shaft 24, with the flap 25 being caused to toggle suddenly and cleanly from its second position to its first position.

It should be observed that the moving assembly 9 may be fitted with a rod 40 passing in sealed manner through the end wall 19 and thereby enabling a member external to the motor to be actuated, e.g. a metering pump.

The flap actuator means, in particular the crank 33 and the spring 34 are preferably situated outside the body 12 connecting the pistons 10 and 11 together, thereby making them directly accessible for repair purposes by removing the bell 7.

I claim:

1. A reciprocating hydraulic motor having a differential piston interposed between an inlet duct for communicating a fluid at a pressure P1 and an exhaust duct for communicating a fluid at a pressure P2 less than P1, and comprising:

a stepped cylinder;

a moving assembly including a cavity and two interconnected pistons of different sections, mounted to slide in sealing engagement with inside portions of the stepped cylinder and defining three variable-volume chambers including an inlet chamber interposed between said two pistons and in communication with said inlet duct, an exhaust chamber situated on a side of the piston with a smaller section which is opposite to said inlet chamber and in communication with said exhaust duct, and an intermediate chamber situated on a side of the piston with a larger section which is opposite to said inlet chamber;

a first passage for temporarily placing said inlet chamber in communication with said intermediate chamber;

a second passage for temporarily placing said intermediate chamber in communication with said exhaust chamber; and control means for alternatingly opening and closing said first and second passages during each of a plurality of operating cycles;

wherein said first passage and said second passage are formed by said cavity and by three ducts for placing said cavity in communication with said inlet chamber, with said exhaust chamber, and with said intermediate chamber, respectively; and wherein said control means includes a single flap disposed in said cavity and pivotally mounted on a pivot shaft situated in a plane defined by said flap and extending substantially perpendicular to a plane defined by said ducts, and actuator means for operating said flap and operatively associated with said moving assembly, for moving said flap between two different positions during each of said operating cycles including a first position in which said inlet chamber communicates with said intermediate chamber, and said exhaust chamber is isolated, and a second position in which said intermediate chamber communicates with said exhaust chamber, and said inlet chamber is isolated.

2. The motor of claim 1 wherein in each of said two positions, said flap bears against two wall portions of said moving assembly which are situated on opposite sides of the plane defined by said flap;

wherein a first wall portion is disposed on the same side of the plane defined by said flap as the fluid at the pressure P1, and a second wall portion is disposed on the same side of the plane defined by said flap as the fluid at the pressure P2; and wherein the second wall portion is spaced farther from the pivot shaft than is the first wall portion so that fluid pressures acting on faces of the flap establish a positive closure torque.

3. The motor of claim 2 wherein the actuator means includes:

a trip rod slidably mounted in said moving assembly to slide parallel to displacement of said pistons, for displacement relative to said moving assembly when ends of said trip rod come into abutment with inner walls of said stepped cylinder;

a crank mounted to the pivot shaft of said flap;

a spring connected between said crank and said trip rod, for toggling the flap during displacement of the trip rod.

4. The motor of claim 3 wherein said crank is mounted to said pivot shaft so that a torque exerted by the spring after the toggling of said flap is greater than the positive closure torque exerted by said fluid pressures.

5. The motor of claim 4 wherein said pivot shaft includes two diametrically opposite lugs for engaging two sector-shaped openings for pivotally receiving said shaft.

6. The motor of claim 5 wherein said lugs cooperate with said openings to provide an angular clearance about the pivot shaft in conjunction with displacements of said trip rod.

7. The motor of claim 1 wherein the cavity of said moving assembly includes two mutually parallel walls which extend substantially perpendicular to the pivot shaft and which cooperate with the flap.

8. The motor of claim 1 wherein the cavity is enclosed by a body, and wherein the actuator means are situated outside said body, for direct access for maintenance and repair.

9. The motor of claim 1 wherein the moving assembly is enclosed by a bell which is removably mounted to the stepped cylinder, for accessing the actuator means.

* * * * *